US005515993A

United States Patent [19]

McManus

[11] Patent Number: 5,515,993

[45] Date of Patent: May 14, 1996

[54] HINGED SEMI-RIGID CONTAINER HAVING WALL STIFFENING MEANS

[75] Inventor: Michael W. McManus, Fairport, N.Y.

[73] Assignee: Tenneco Plastics Company, Evanston, Ill.

[21] Appl. No.: 354,332

[22] Filed: Dec. 12, 1994

[51] Int. Cl.[6] ..... B65D 43/14

[52] U.S. Cl. ..... 220/339; 206/508; 206/518; 206/519; 229/406; 220/4.23; 220/337

[58] Field of Search ..... 220/4.23, 339, 220/337, 523, 526; 229/406, 407; 206/508, 518, 519, 521.1–521.19

[56] References Cited

U.S. PATENT DOCUMENTS

| | | | |
|---|---|---|---|
| 3,303,964 | 2/1967 | Luker | 206/508 X |
| 3,362,575 | 1/1968 | Fotos | 206/508 |
| 4,419,068 | 12/1983 | Congleton | 206/521.1 X |
| 4,650,076 | 3/1987 | Padovani | 206/521.1 X |
| 4,962,854 | 10/1990 | Ricci | 206/387 |
| 5,012,928 | 5/1991 | Proffitt et al. | 206/508 |
| 5,046,659 | 9/1991 | Warburton | 229/2.5 |
| 5,092,479 | 3/1992 | Wells | 220/4.23 |
| 5,145,068 | 9/1992 | Schmitz et al. | 220/339 X |
| 5,158,209 | 10/1992 | Reil et al. | 222/129 |

*Primary Examiner*—Allan N. Shoap
*Assistant Examiner*—Robin A. Hylton
*Attorney, Agent, or Firm*—Arnold, White & Durkee

[57] ABSTRACT

A thermoplastic hinged container having stiffened side walls and having spaced channels in a shoulder/flange seal portion of the container base and mating stiffening lugs in an opposing lid portion to prevent warping of the container during closure and provide improved sealing.

4 Claims, 1 Drawing Sheet

10
11
11A
11C
11F
11S
11V
12
12A
12C
12F
12L
20
3

HINGED SEMI-RIGID CONTAINER HAVING WALL STIFFENING MEANS

BACKGROUND OF THE INVENTION

This invention relates to improvements in hinged containers. In particular, it relates to a thermoformed container having uniformly thick walls joined by a living or "live" hinge structure.

Containers for food or other goods are currently manufactured by thermoforming polystyrene sheet. Typical clear thermoplastic containers are disclosed in U.S. Pat. No. 5,046,659 (Warburton), incorporated herein by reference.

It is also desirable to form a closed stackable container for food or other articles comprising a lid and a mating base each having a fluted pattern comprising a uniformly spaced series of stiffening wall flutes extending around the periphery of the container. The top and bottom container wall flutes in both of the flute patterns may be shaped to interlock with each other in stacking relationship.

The prior art thermoplastic containers are formed with a semi-rigid, resilient hinge joining the lid and base members and sufficiently flexible to permit bending 180° during closure. The resiliency of a living hinge tends to hold the container in the open position unless closed and latched. This type of hinge is substantially the same thickness as the container (i.e. - about 0.4 mm or 0.015 inch). The relatively thick hinge tends to warp the side walls of the base and lid in the vicinity of the hinge, causing a gap in the container seal after closure. This is due to the relative greater stiffness of the hinge portion. While the hinge can be weakened by scoring or creasing the hinge line, this is not an acceptable technique for maintaining a living hinge and may not avoid gapping between the base and lid. Also, the side wall distortion and seal gap problem may be avoided by substituting a latch for the hinge; but, this loses the advantage of a one-piece, integrally formed article and increases the complexity of the closure.

It has been found that the closure warp problem can be overcome by providing stiffening to the adjacent walls by forming a spaced series of channels along a top shoulder of the base adjacent to the hinge, with each of the channels extending from the shoulder top to a sealing flange portion, thereby stiffening the base wall in the vicinity of the hinge. A mating series of protruding lugs is provided in the lid member opposite the channels adapted for closing into the channels and providing the same stiffening effect as the base.

SUMMARY OF THE INVENTION

A semi-rigid thermoplastic container is provided, including base and lid members having uniformly thick, vertically fluted walls and a Uniformly thick living hinge joining the base and lid members along a straight edge thereof. The improvement comprises: a horizontal first flange portion or depending lip formed along a top edge and extending around the periphery of the base member; a mating second flange portion formed along an opposing edge of the lid member, adapted for engagement with the first flange portion and thereby forming a seal upon closure of the container; the base member having a top shoulder extending upwardly around the base walls and having the first flange portion depending downwardly therefrom.

A spaced series of channels is formed along the top shoulder adjacent to the hinge, with each of the channels extending from the shoulder top to the flange portion, thereby stiffening the base wall in the vicinity of the hinge. A mating series of protruding lugs is formed in the lid member opposite the channels and adapted for closing into the channels to stiffen the lid wall.

Advantageously, the container of is provided with a flute pattern comprising a plurality of stiffening flutes extending around the periphery of the container arranged and shaped to interlock with each other.

The preferred container design has channels comprising a plurality of V-shaped indents having inwardly sloping channel sides perpendicular to the base wall surface and transverse to the hinge.

DETAILED DESCRIPTION OF THE PREFERRED EMBODIMENT

Figures 1, 2, 3:
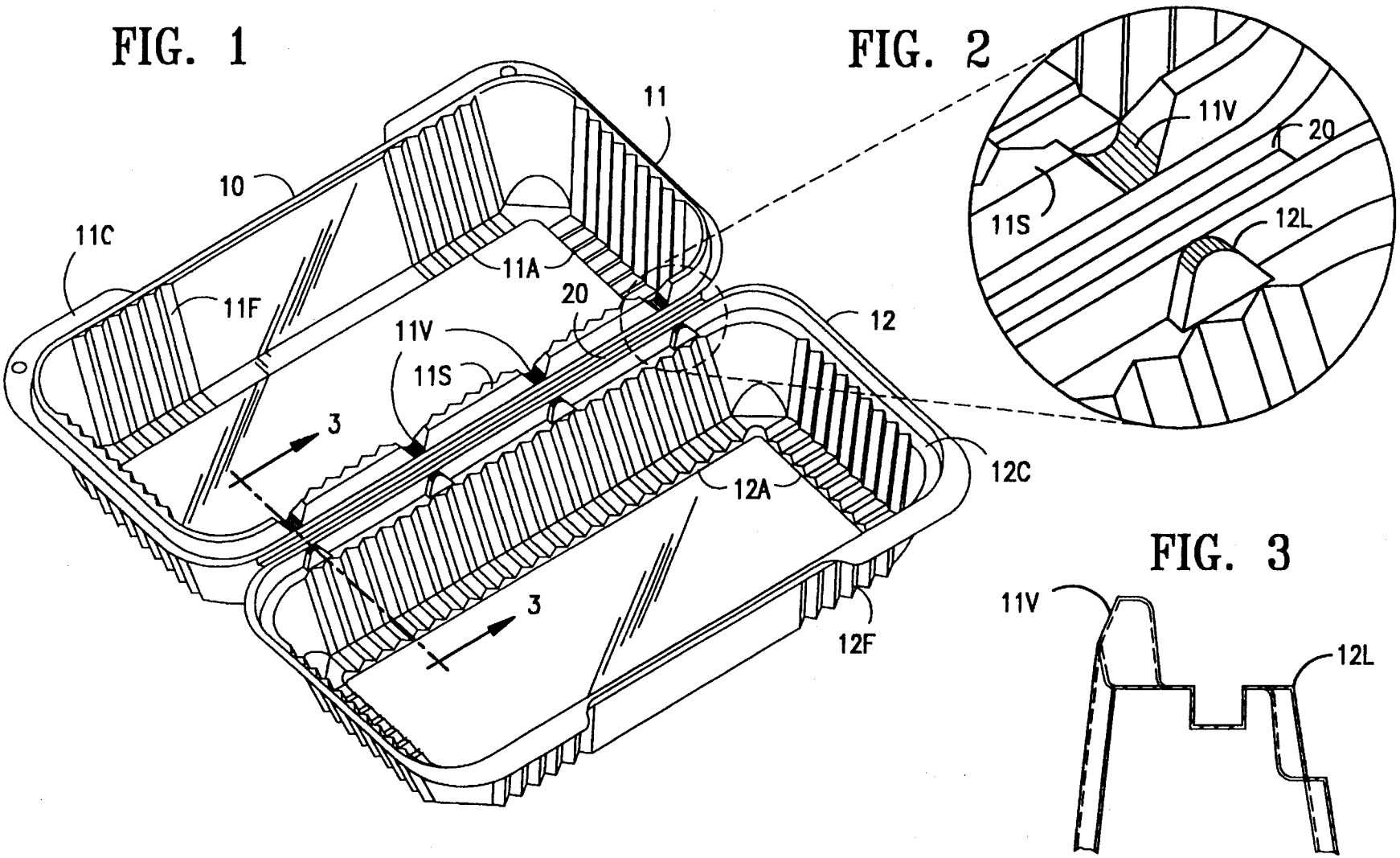
FIG. 1 is a perspective view of a thermoplastic container according to the present invention.
FIG. 2 is an enlarged view of a portion of FIG. 1.
FIG. 3 is a cross-sectional view along line 3—3 of FIG. 1.

Referring now to the drawings, there is shown in FIG. 1 a nestable and stackable semi-rigid container 10 having a deep recessed base 11 and a mating highly raised lid 12 of the type used in the prior art to provide nesting of the open containers prior to closure. In the perspective of FIG. 1 the open container cavities face upward when in an open condition. The raised portions 12A on the lid 12 projects into recesses 11A in the base when the containers 10 are stacked. These interlocking parts enable the stacks to display merchandized goods, and the interlock also facilitates stacking alignment. The sidewalls of the lid 12 and base 11 of the container 10 may be provided with flutes 12F and 11F to strengthen the sidewalls. The flutes 12F and 11F are aligned with each other from lid 12 to base 11 as shown in FIG. 1.

The containers 10 in the prior art are thermoformed from any suitable plastic material. One clear plastic material which is particularly suitable is oriented general purpose polystyrene (OPS). Other thermoformed plastic materials way be used depending upon the end use of the containers. A suitable latching structure is disclosed by Warburton in U.S. Pat. No. 5,046,659.

The semi-rigid thermoplastic container includes base and lid members having uniformly thick, vertically fluted walls and a uniformly thick living hinge 20 joining the base and lid members along a straight edge thereof. The improvement herein comprises a horizontal first flange portion 11C formed along a top edge and extending at least partially around the periphery of the base member 11. A mating second flange portion 12C is formed along an opposing edge of the lid member, adapted for engagement with the first flange portion and thereby forming a seal upon closure of the container. The base member has a top shoulder 11S which extends from one edge of the base wall, the top shoulder extending from the edge of the base wall upwardly, transversely outwardly, then downwardly and terminating in a lower edge. The first flange portion 11F extends from the lower edge of said top shoulder transversely toward the hinge along one edge thereof. Referring to FIGS. 2 and S, V-shaped channels or recesses 11V are disposed along the top shoulder 11S adjacent to the hinge 20, each of the channels extending from the shoulder top to the flange portion 11C, thereby stiffening the base wall in the vicinity of the hinge. A mating series of protruding lugs 12L are formed in the lid member opposite channels 11V and are adapted for closing into the channels, which also stiffens the lid wall in the vicinity of the hinge. It is preferred that the mating channels and lugs are spaced from outer locations near the ends of hinge 20 with one or more interior channels. The spacing is a matter of design and material choice, with elongated containers requiring more stiffening channels than a shorter square design, for instance.

The shape of channels 11V are such as to enable thermoforming from a sheet of plastic material whereby the open containers can be stacked inside one another in a nesting relationship. This feature is achieved by having a V-shape or U-shape indent having straight or inward sloping channel sides perpendicular to the wall surface and transverse to the hinge axis.

The design improvement permits the overlapping lid and base to be relatively rigid along the length of the hinge and avoids excessive hinge gapping.

The present invention reduces or eliminates the seal gap problem without adversely affecting the thermoforming process or requiring extreme or diverse material processing, which might degrade the overall product formation and/or material uniformity. The preferred plastic material is general purpose polystyrene (e.g. - BASF 1800) or HIPS type styrene polymer having a suitable elastic modulus.

While the invention has been described by particular example, there is no intention to limit the inventive concept except as set forth in the following claims.

I claim:

1. In a semi-rigid thermoplastic container including base and lid members having uniformly thick, vertically fluted walls and a single uniformly thick living hinge joining the base and lid members along a straight edge thereof and having open container cavities facing upward when in an open condition, the improvement which comprises:

a horizontal first flange portion formed along a top edge and extending around the periphery of the base member;

a mating second flange portion formed along an opposing edge of the lid member, adapted for engagement with the first flange portion and thereby forming a seal upon closure of the container, said hinge joining the base and lid members along the flange portions thereof in said open container condition;

said base member having a top shoulder, said top shoulder comprising an upwardly extending wall portion, a transversely extending wall portion and a downwardly extending wall portion terminating in a lower edge, said first flange portion extending transversely from said lower edge toward said hinge along said straight edge;

said horizontal first flange being in one plane about the periphery of said base member;

a spaced series of channels along the top shoulder adjacent to the hinge, each of said channels extending from the shoulder top to the flange portion, thereby stiffening the base wall in the vicinity of the hinge; and a mating series of protruding lugs formed in the lid member opposite the channels and adapted for closing into the channels, thereby stiffening the lid wall in the vicinity of the hinge.

2. The container of claim 1 wherein said lid and mating base each have vertically fluted walls with a flute pattern comprising a plurality of stiffening flutes extending around the periphery of said container, said flutes in both said lid and base flute patterns being shaped to interlock with each other.

3. The container of claim 1 wherein said channels comprise V-shaped indents having inwardly sloping channel sides perpendicular to the base wall surface and transverse to the hinge.

4. A clear thermoplastic food container formed of oriented polystyrene including integrally formed base and lid members having uniformly thick side walls and a uniformly thick hinge joining the side walls of the base and lid members along a straight edge;

a first sealing lip portion with a shoulder substantially extending around the periphery of a base or lid member;

a mating second sealing lip portion formed along an opposing edge of container, adapted for engagement with the first sealing lip portion and thereby forming a seal upon closure of the container;

said first sealing lip member having a top shoulder extending upwardly around the corresponding side wall;

a spaced series of V-shaped recesses along the shoulder adjacent to the hinge, each of said channel extending from the shoulder top to a peripheral lip seal portion, thereby stiffening the adjacent wall; and a mating series of protrusions formed in the opposing member opposite the recesses and adapted for closing into the recesses.

* * * * *